United States Patent [19]

Inada et al.

[11] 4,050,423

[45] Sept. 27, 1977

[54] IGNITION TIMING ADJUSTING DEVICE FOR INTERNAL COMBUSTION ENGINES

[75] Inventors: Masami Inada, Toyoake; Yasuhiro Kawabata, Toyota; Katsujiro Sato, Toyota; Akinori Osanai, Toyota, all of Japan

[73] Assignees: Aisin Seiki Kabushiki Kaisha; Toyota Jidosha Kogyo Kabushiki Kaisha, BoliviaTH OF JA

[21] Appl. No.: 625,054

[22] Filed: Oct. 23, 1975

[30] Foreign Application Priority Data

| | | |
|---|---|---|
| Oct. 23, 1974 | Japan | 49-122281 |
| Oct. 29, 1974 | Japan | 49-125206 |
| Oct. 29, 1974 | Japan | 49-125207 |

[51] Int. Cl.[2] ..... F02P 5/02

[52] U.S. Cl. ..... 123/117 A; 137/627.5

[58] Field of Search ..... 123/117 A; 137/627.5

[56] References Cited

U.S. PATENT DOCUMENTS

| | | | |
|---|---|---|---|
| 3,394,968 | 7/1968 | Bueler | 137/627.5 X |
| 3,457,905 | 7/1969 | Jukes | 123/117 A |
| 3,559,688 | 2/1971 | Fischer et al. | 137/627.5 |
| 3,599,614 | 8/1971 | Kittredge | 123/117 A |
| 3,650,253 | 3/1972 | Cooksey | 123/117 A |
| 3,998,192 | 12/1976 | Ota | 123/117 A |

*Primary Examiner*—Carroll B. Dority, Jr.
*Assistant Examiner*—Tony M. Argenbright
*Attorney, Agent, or Firm*—Oblon, Fisher, Spivak, McClelland & Maier

[57] ABSTRACT

In an ignition timing adjusting device, a breaker plate of a distributor is held in the initial position thereof during idling of the engine and the breaker plate is temporarily moved in the retarding direction in a period of time after starts of the vehicle to positively retard the ignition timing of the engine so as to minimize the NOx emission and thereafter, instantly moved in the advancing direction upon arrival at a cruising speed of the vehicle to quickly advance the ignition timing of the engine so as to ensure good driveability of the vehicle.

8 Claims, 13 Drawing Figures

IGNITION TIMING ADJUSTING DEVICE FOR INTERNAL COMBUSTION ENGINES

BACKGROUND OF THE INVENTION

The present invention relates to an improvement of an ignition timing adjusting device for controlling the ignition timing of an internal combustion engine to minimize the nitrogen oxide content of exhaust emission (hereinafter described simply as NOx emission).

Conventionally proposed in such an ignition timing adjusting device of this type as disclosed in the U.S. Pat. No. 3,735,743. With this conventional device, the function of a conventional vacuum ignition advancer is retarded to temporarily retard the ignition timing of the engine during the period of transitional driving when acceleration and deceleration are repeated, and then the normal or usual timing is maintained at a cruising speed of the vehicle. However, in this conventional device, the response of the vacuum ignition advancer is merely retarded at the advancing side and the response in the retarding side is not considered. This indicates that there is a limit to decrease the Nox emission at a low speed after the vehicle starts.

SUMMARY OF THE INVENTION

The main object of the present invention is to provide an ignition timing adjusting device wherein a breaker plate of a distributor is held in the initial position thereof during idling of the engine and the breaker plate is temporarily moved in the retarding direction in a period of time after starts of the vehicle to positively retard the ignition timing of the engine so as to minimize the NOx emission and thereafter, instantly moved in the advancing direction upon arrival at a cruising speed of the vehicle to quickly advance the ignition timing of the engine so as to ensure good driveability of the vehicle.

According to the present invention, there is provided an ignition timing adjusting device for an internal combustion engine having a carburetor and a distributor for the engine, which comprises a vacuum actuator including a diaphragm connected to an element of the distributor to move the element of the distributor in the advancing or retarding direction, the diaphragm forming first and second servo-chambers within the actuator; a change-over valve means interposed between the throttle valve of the carburetor and the actuator for selectively connecting the first and second servo-chambers to the atmospheric pressure and a negative pressure port upstream of the throttle valve therethrough, the valve means being switchedover from the first position to the second position with a predetermined time lag after occurrence of negative pressure at the throttle valve; means for delaying the switchover timing of the valve means to provide the time lag. In the ignition timing adjusting device, when the valve means is conditioned in the first position, the first and second servo-chambers of the actuator are respectively connected through the valve means to the atmospheric pressure and the negative pressure port such that when the throttle valve is closed, the diaphragm of the actuator is conditioned in the original position thereof to hold the element of the distributor in its initial position and when the throttle valve is opened to supply negative pressure into the second servo-chamber of the actuator through the negative pressure port, the diaphragm is moved in one direction due to pressue difference between the two servo-chambers to move the element of the distributor in the retarding direction until the valve means is switched-over from the first position to the second position with the time lag, and thereafter when the valve means is switched-over to the second position, the first and second servo-chambers of the actuator are respectively connected through the valve means to the negative pressure and the atmospheric pressure so that the diaphragm is moved in the other direction due to pressure difference between the two servo-chambers to move the element of the distributor in the advancing direction.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENT

Figure 1:
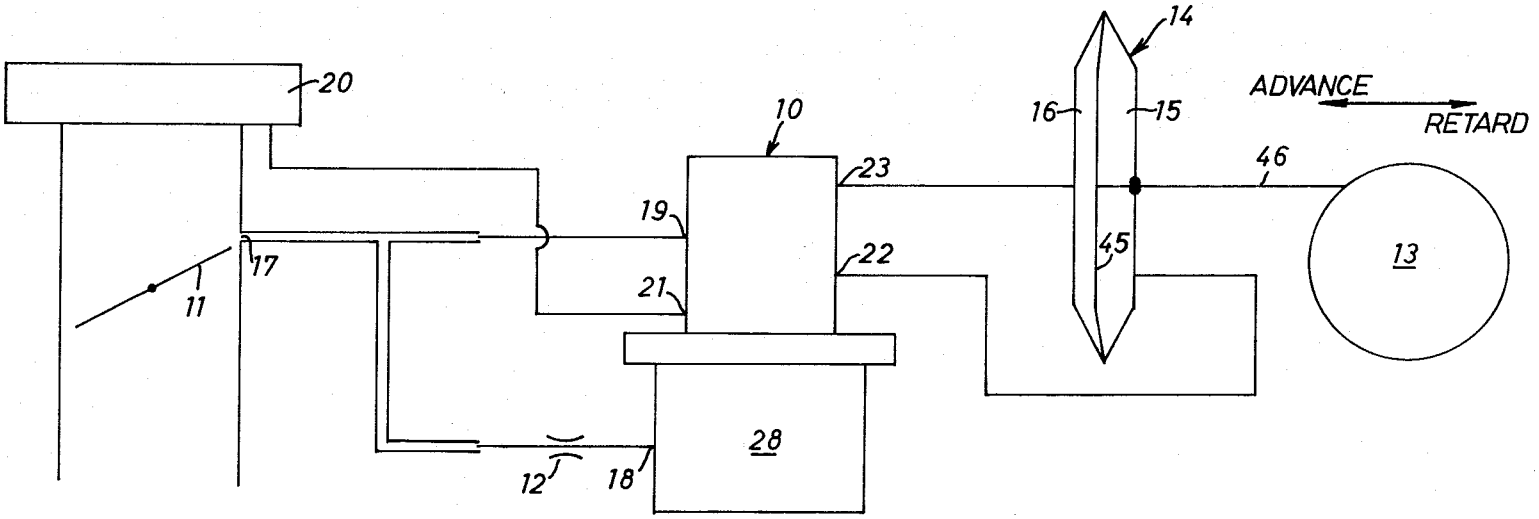
FIG. 1 illustrates a schematic diagram of a first preferred embodiment of the present invention.

Referring now to the drawings, in FIG. 1 there is schematically illustrated an ignition timing adjusting mechanism in accordance with the present invention, which comprises a distributor 13 for an internal combustion engine, a vacuum actuator 14 to operate the breaker plate of the distributor 13 in the retarding or advancing direction, and a vacuum change-over valve 10 to control operation of the actuator 14 in response to negative pressure of a throttle valve 11 of a carburetor.

The vacuum actuator 14 is provided therein with a diaphragm 45 forming first and second servo-chambers 15 and 16. The diaphragm 45 is operatively connected to the breaker plate of the distributor 13 by way of a linkage 46. With this vacuum actuator 14, the ignition timing of the engine is retarded when the diaphragm 45 moves rightward due to pressure difference between the two servo-chambers 15 and 16 to operate the breaker plate in the retarding direction from the initial or standard position thereof. Conversely, the ignition timing is advanced when the diaphragm 45 moves leftward to operate the breaker plate in the advancing direction from the initial position.

The vacuum change-over valve 10 is provided with a first inlet port 19 in direct communication with a negative pressure port 17 of the carburetor, a second inlet port 21 in open communication with an air cleaner 20 and a signal inlet port 18 connected to the negative pressure port 17 by way of a sintered metal orifice 12. The change-over valve 10 is further provided with first and second outlet ports 22 and 23 which are connected with the first and second servo-chambers 15 and 16 of the vacuum actuator 14, respectively. The negative pressure port 17 is provided slightly upstream of the fully closed position of the throttle valve 11. The change-over valve 10 operates in such a manner that, when the throttle valve 11 is fully closed, the first and second inlet ports 19 and 21 are respectively connected to the first and second outlet ports 22 and 23 so that the first and second servo-chambers 15 and 16 of the actuator 14 are respectively communicated with the negative pressure port 17 and the atmospheric air. When the throttle valve 11 is opened, the first and second inlet ports 19 and 21 are respectively connected to the second and first outlet ports 23 and 22 with a time lag in response to negative pressure applied to the signal inlet port 18 from the negative pressure port 17 through the orifice 12 so that the first and second servo-chambers 15 and 16 are respectively communicated with the atmospheric air and the negative pressure port 17.

Figure 2:
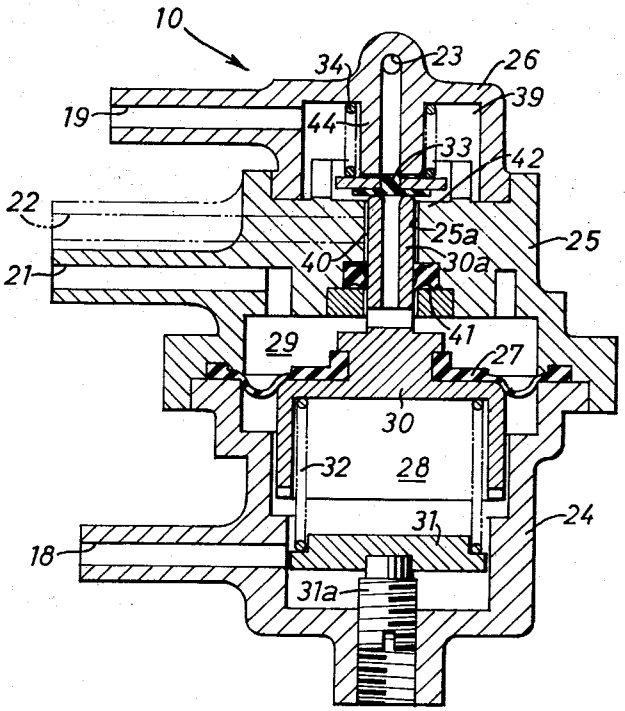
FIG. 2 is a vertically cross-sectional view of a change-over valve adapted to the first embodiment.

FIG. 2 illustrates a preferred embodiment of the change-over valve 10 which comprises a bottom body 24, an intermediate body 25 hermetically coupled with the bottom body 24, and a head body 26 hermetically coupled with the intermediate body 25. The bottom body 24 is provided thereon with a signal inlet port 18, corresponding with the signal inlet port in FIG. 1, and the intermediate body 25 is provided thereon with a second inlet port 21 and a first outlet port 22, corresponding respectively with the second inlet port and the first outlet port of FIG. 1. Between the bottom body 24 and the intermediate body 25 a diaphragm 27 is hermetically interposed and clamped to form a vacuum chamber 28 in open communication with the signal inlet port 18 and an air chamber 29 in open communication with the second inlet port 21. The diaphragm 27 has a piston 30 which is integrally secured at the neck portion thereof on the central portion of the diaphragm 27. The piston 30 is constantly biased upward by a compression coil spring 32 interposed between a stopper plate 31 and the piston 30. The stopper plate 31 is fixedly mounted on an adjusting screw 31*a* threaded on the bottom body 24. A tubular extension 30*a* of the piston 30 is inserted through a sealing cup 41 into a cylindrical bore 25*a* of the intermediate body 25 to form an annular passage 40 in open communication with the first outlet port 22.

The head body 26 is provided thereon with a first inlet port 29 and a second outlet port 23, corresponding respectively with the first inlet port and the second outlet port in FIG. 1. In the interior 39 of this head body, assembled is a puppet valve element 33 which is interposed between the tubular extension 30*a* of the piston 30 and a tubular boss 44 of the head body 26. The puppet valve element 33 is constantly biased downward by a compression coil spring 34 disposed between the inner wall of the head body 26 and the valve element 33, the biasing force of the coil spring 34 being smaller than that of the coil spring 32.

With this change-over valve 10, when no negative pressure exists in the vacuum chamber 28, the tubular extension 30*a* of the piston 30 is in contact with the bottom face of the valve element 33 due to the biasing force of the coil spring 32 and the valve element is in contact with the tubular boss 44 against the biasing force of the coil spring 34. In this condition, the first inlet port 19 is connected to the first outlet port 22 across the interior 39 of the head body 26 and the annular passage 40, whereas the second inlet port 21 is blocked by the valve element 33.

When negative pressure exists in the vacuum chamber 28, the diaphragm 27 and the piston 30 are moved downward against the biasing force of the coil spring 32 due to pressure difference between the two chambers 28 and 29 and, in turn, the tubular extension 30*a* of the piston 30 separates from the valve element 33 so that the valve element 33 is separated from the tubular boss 44 of the head body 26 by the biasing force of the coil spring 34 and sits on a shoulder 42 of the intermediate body 25. In this condition, the first inlet port 19 is connected to the second outlet port 23 across the interior 29 of the head body 26, whereas the second inlet port 21 is connected to the first outlet port 22 across the air chamber 29, the tubular extension 30*a* and the annular passage 40.

In operation of the ignition timing adjusting mechanism, while the throttle valve 11 is fully closed in idling of the engine, no negative pressure exists in the vacuum chamber 28 of the change-over valve 10, since negative pressure does not appear at the negative pressure port 17 of the carburetor. Thus, the change-over valve 10 remains in the original condition, as shown in FIG. 2, wherein the first inlet port 19 is connected to the first outlet port 22 and the communication between the second inlet port 21 and the second outlet port 23 is blocked by the puppet valve element 33. Under this condition, the first servo-chamber 15 of the actuator 14 is communicated with the atmospheric pressure existing upstream of the throttle valve 11 and the second servo-chamber 16 is also filled with the atmospheric pressure; the reason why the atmospheric pressure remains in the chamber 16 will be described later in detail. This condition is represented by the A-area of a graph shown in FIG. 3. This means that the diaphragm 45 of the actuator 14 stays in its original position so that the breaker plate of the distributor 13 stays in the initial position thereof as shown in the A-area of FIG. 4.

Figure 3:
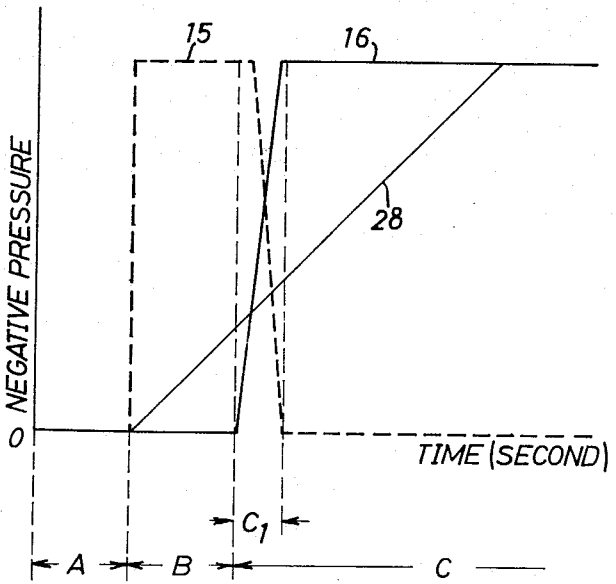
FIG. 3 is a graph showing change of negative pressure to be applied to a vacuum actuator of the first embodiment in relation to time.
Figure 4:
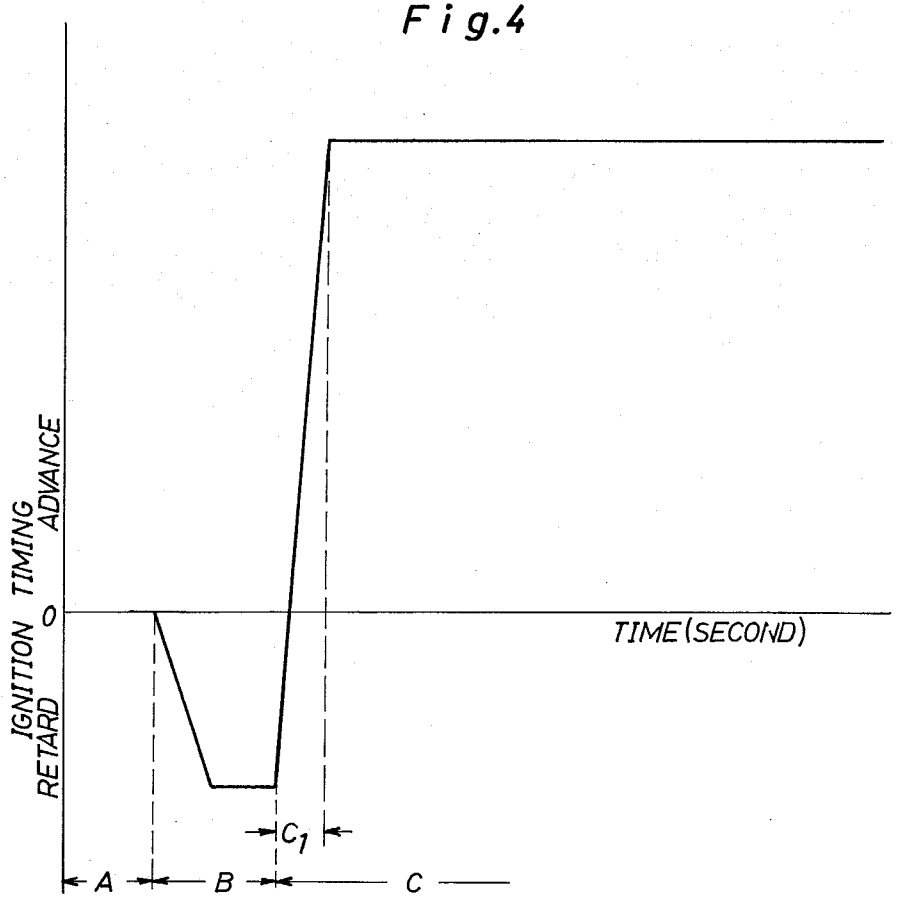
FIG. 4 is a graph showing change of the ignition timing of the engine according to the first embodiment.

When the throttle valve 11 is gradually opened to start and accelerate the vehicle, as shown in the B-area of FIG. 3, the negative pressure downstream of the throttle valve 11 becomes high enough to be transmitted to the first servo-chamber 15 of the actuator 14 through the negative pressure port 17, the first inlet and outlet ports 19 and 22 of the valve 10 so that the diaphragm 45 is moved rightward by pressure difference between the two servo-chambers 15 and 16 and the breaker plate of the distributor 13 is moved in the retarding direction from the initial position, as shown in the B-area of FIG. 4. At the same time, the negative pressure is applied to the vacuum chamber 28 of the valve 10 through the orifice 12. Thus, the rightward movement of the diaphragm 45 and the retarding movement of the breaker plate continue until the negative pressure value in the chamber 28 of the valve 10 reaches a predetermined one so that the ignition timing of the engine is temporarily retarded in a predetermined period of time to reduce the NOx emission and, under this condition, the vehicle speed reaches a cruising speed by shifting operation of the transmission of the vehicle.

Thereafter, when the negative pressure value in the vacuum chamber 28 of the valve 10 reaches the predetermined one and the diaphragm 27 and the piston 30 move downward against the biasing force of the coil spring 32 due to pressure difference between the vacuum and air chambers 28 and 29, the valve 10 is switched-over by the downward movement of the puppet valve element 33. Then, the first inlet port 19 is connected to the second outlet port 23 to communicate the second servo-chamber 16 of the actuator 14 with the negative pressure of the throttle 11, whereas the second inlet port 21 is connected to the first outlet port 22 to communicate the first servo-chamber 15 of the actuator 14 with the atmospheric pressure by way of the air cleaner 20, as shown in the $C_1$-area of FIG. 3.

As a result, the diaphragm 45 of the actuator 14 is instantly moved leftward by pressure difference between the two servo-chambers 15 and 16, and subsequently the breaker plate of the distributor 13 quickly advances the ignition timing of the engine, as shown in the $C_1$-area of FIG. 4, so that when the engine is running normally at a cruising speed the normal ignition timing of the conventional device is maintained to ensure a best fuel burning efficiency or driveability of the engine, as shown in the C-area of FIG. 4.

Moreover, when the throttle valve 11 is temporarily closed to decelerate the vehicle or fully closed to arrest the vehicle, the second servo-chamber 16 of the actuator 14 is connected to the atmospheric pressure appearing upstream of the throttle valve 11 through the negative pressure port 17, the first inlet port 19 and the second outlet port 23 of the valve 10 before the vacuum chamber 28 of the valve 10 is filled with the atmospheric pressure to switchover the valve 10. Thus, the second servo-chamber 16 of the actuator 14 is filled with the atmospheric pressure, as previously described, when the change-over valve 10 is conditioned in its original position.

Figure 5:
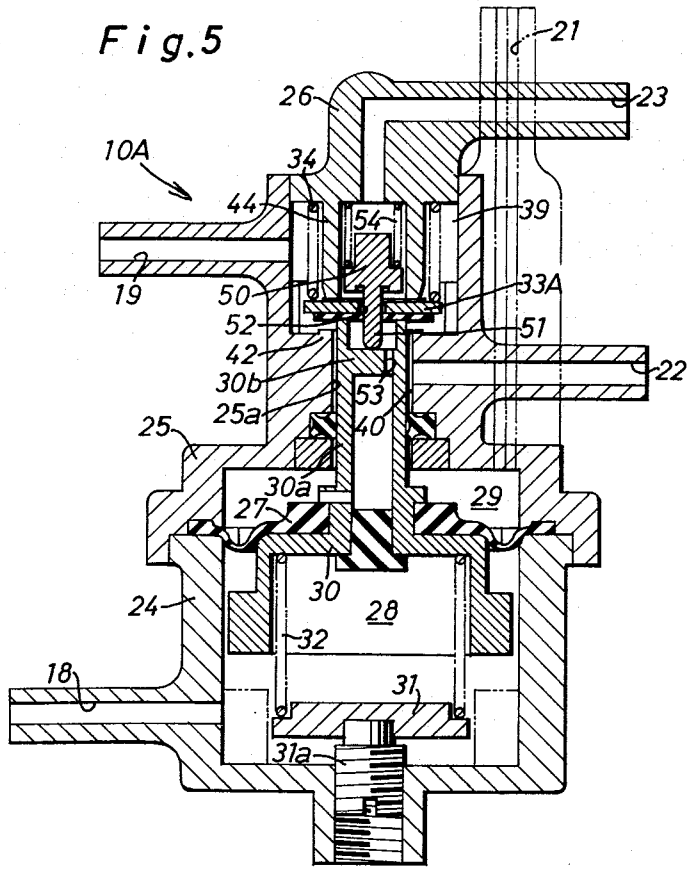
FIG. 5 is a vertically cross-sectional view of a modification of the change-over valve of FIG. 2.

In FIG. 5, there is illustrated a modification of the above described change-over valve 10 wherein the parts and portions substantially as same in function as those of the change-over valve 10 are designated by the same reference numerals used in FIG. 2. This modified change-over valve 10A is characterized in that a second valve element 50 is associated with a first valve element 33A comparable to the valve element 33 of FIG. 2. The second valve element 50 is biased downward by a compression coil spring 54 disposed between the inner wall of the head body 26 and the valve element 50 and has a projection 51 which is inserted into a through hole 52 provided on the center of the first valve element 33A and engageable with a partition wall **30*b* of the tubular extension 30*a* of the piston 30. And the total of the biasing forcing of the springs 34 and 54 is smaller than that of the spring 32**.

With this modified change-over valve 10A, when no negative pressure exists in the vacuum chamber 28, the tubular extension **30*a* of the piston 30 is in contact with the bottom face of the first valve element 33A by the biasing force of the spring 32 to push up the second valve element 50 against the biasing force of the spring 54 and, in turn, the first valve element 33A is in contact with the tubular boss 44 against the spring 34. In this condition, the first inlet port 19 is connected to the first outlet port 22 across the interior 39 of the head body 26 and the annular passage 40, whereas the second inlet port 21 is connected to the second outlet port 23 across the air chamber 29, the interior of the tubular extension 30*a*, a hole 53 and the through hole 52**.

When negative pressure exists in the vacuum chamber 28, the diaphragm 27 and the piston 30 move downward against the biasing force of the coil spring 32 due to pressure difference between the two chambers 28 and 29 and, in turn, the tubular extension **30*a* of the piston 30 separates from the first valve element 33A so that the first valve element 33A is separated from the tubular boss 44 of the head body 26 by the biasing force of the coil spring 34 and sits on the shoulder 42 of the intermediate body 25 and subsequently the second valve element 50 engages the upper face of the first valve element 33A by the biasing force of the spring 54 to close the through hole 52 of the first valve element 33A. Thus, the first inlet port 19 is connected to the second outlet port 23 across the interior 29 of the head body 26, whereas the second inlet port 21 is connected to the first outlet port 22 across the air chamber 29, the interior of the extension 30*a* of the piston 30, the hole 53 and the annular passage 40**.

Figure 6:
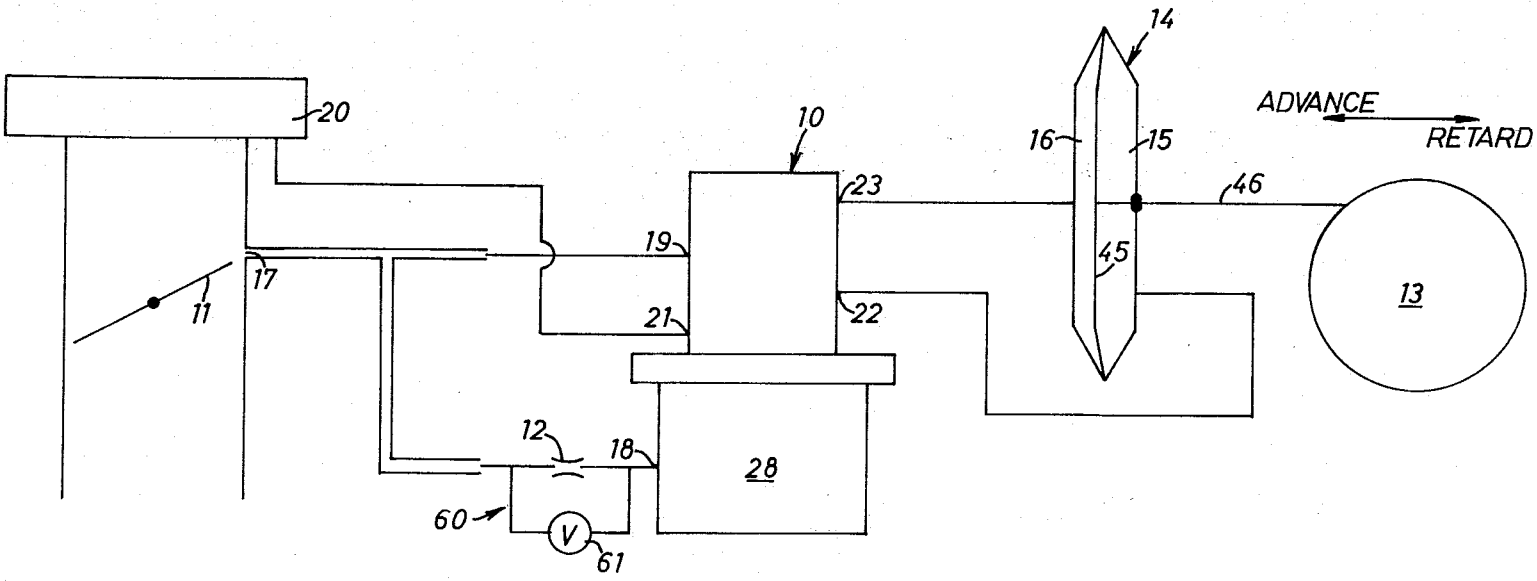
FIG. 6 illustrates a schematic diagram of a second preferred embodiment of the present invention.

FIG. 6 discloses a second embodiment of the present invention wherein a switching valve assembly 60 with a bypass valve 61 is adapted to the ignition timing adjusting mechanism shown in FIG. 1 and the remaining parts and portions are designated by the same reference numerals as those of FIG. 1. This second embodiment is characterized in that when the predetermined negative pressure is applied to the vacuum chamber 28 of the change-over valve 10 across the orifice 12, the bypass valve 61 is opened to directly connect the signal inlet port 18 of the valve 10 to the negative pressure port 17 so as to prompt the switch-over operation of the valve 10.

Figure 7:
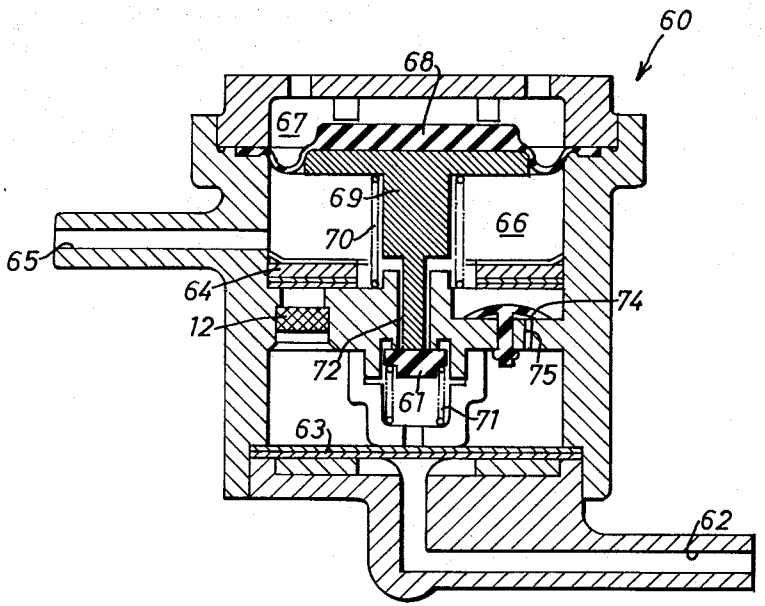
FIG. 7 depicts a vertical cross-section of a switching valve assembly adapted to the second embodiment of FIG. 6.

As shown in FIG. 7, the orifice 12 and the bypass valve 61 are assembled within a housing of the switching valve assembly 60 which comprises an inlet port 62 to be connected to the negative pressure port 17 and an outlet port 65 to be connected to the signal inlet port 18 of the change-over valve 10. In the interior of the valve housing, a diaphragm 68 forms a chamber 66 in open communication with the outlet port 65 and an air chamber 67 opening to the exterior, and the inlet port 62 is communicated with the outlet port 65 by way of a first element 63, the sintered metal orifice 12, a second filter element 64 and the chamber 66. The diaphragm 68 is integrally provided thereon with a plunger 69 which is biased upward by a compression coil spring 70. The plunger 69 is inserted at its small diameter portion into a bypass passage 72 and engages the bypass valve 61. The bypass passage 72 is normally closed by the bypass valve 61 which is biased upward by a compression coil spring 71. The switching valve assembly 60 is further provided therein with a check valve 74 to permit air flow from the inlet port 62 to the chamber 66. This check valve 74 opens a through hole 75 to provide direct communication between the inlet port 62 and the chamber 66 when negative pressure exists in the chamber 66 and the inlet port 62 is communicated with the atmospheric pressure appearing upstream of the throttle valve 11.

With this switching valve assembly 60, when negative pressure appearing downstream of the throttle valve 11 is applied to the vacuum chamber 28 of the change-over valve 10 through the inlet port 62, the orifice 12, the chamber 66 and the outlet port 65 and subsequently the negative pressure value in the chamber 66 reaches a predetermined one, the diaphragm 68 and the plunger 69 are moved downward against the biasing forces of the springs 70 and 71 by pressure difference between the two chambers 66 and 67 to open the bypass valve 61. Thus, the chamber 66 and the vacuum chamber 28 are directly communicated with the negative pressure port 17 through the bypass passage 72 so that switchover operation of the valve 10 is promptly conducted.

Thereafter, when the throttle valve 11 is temporarily closed to decelerate the vehicle and the inlet port 62 of the switching valve assembly 60 is temporarily communicated with the atmospheric pressure appearing upstream of the throttle valve 11, the check valve 74 is opened due to difference between the negative pressure in the chamber 66 and the atmospheric pressure applied to the inlet port 62 so that the vacuum chamber 28 of the valve 10 and the chamber 66 are instantly filled with the atmospheric pressure to switchover the valve 10 in its original position.

Hereinafter, the mode of operation of this embodiment will be described. While the throttle valve 11 is fully closed in idling of the engine, no negative pressure exists in the vacuum chamber 28 of the change-over valve 10, since negative pressure does not appear at the negative pressure port 17 of the carburetor. Thus, the change-over valve 10 remains in the original condition, as shown in FIG. 2, wherein the first inlet port 19 is connected to the first outlet port 22 and the communication between the second inlet port 21 and the second outlet port 23 is blocked by the puppet valve element 33. Under this condition, the first servo-chamber 15 of the actuator 14 is communicated with the atmospheric pressure appearing upstream of the throttle valve 11 and the second servo-chamber 16 is also filled with the atmospheric pressure, as previously described. This condition is represented by the A-area of a graph shown in FIG. 8. This means that the diaphragm 45 of the actuator 14 stays in its original position and the breaker plate of the distributor 13 stays in the initial position thereof as shown in the A-area of FIG. 9.

Figure 8:
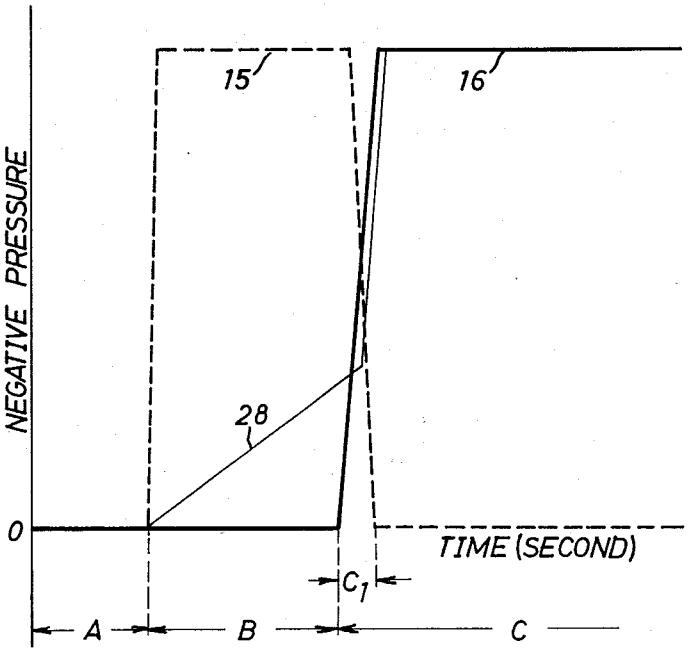
FIG. 8 is a graph showing change of negative pressure to be applied to the vacuum actuator of the second embodiment in relation to time.
Figure 9:
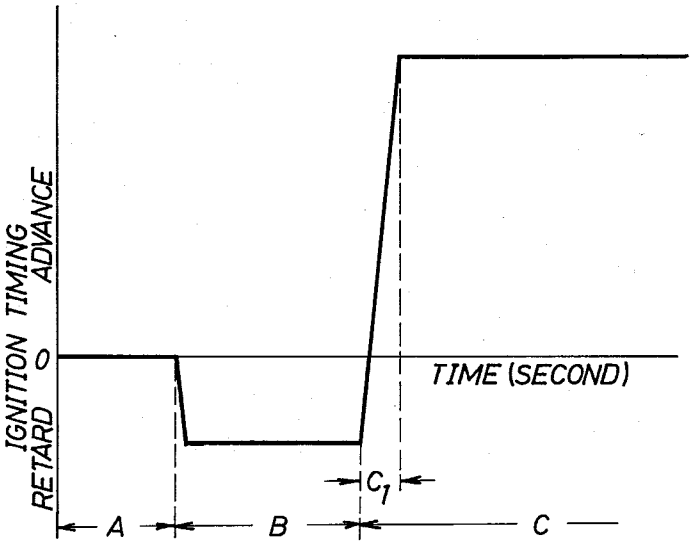
FIG. 9 is a graph showing change of the ignition timing of the engine according to the second embodiment.

When the throttle valve 11 is gradually opened to start and accelerate the vehicle, the negative pressure appearing downstream of the throttle valve 11 becomes high enough to be applied to the first servo-chamber 15 of the actuator 14 through the negative pressure port 17, the first inlet and outlet ports 19 and 22 of the valve 10, as shown in the B-area of FIG. 8, so that the diaphragm 45 of the actuator 14 is moved rightward by pressure difference between the two servo-chambers 15 and 16 and the breaker plate of the distributor 13 is moved in the retarding direction from the initial position, as shown in the B-area of FIG. 9. At the same time, the negative pressure is applied to the vacuum chamber 28 of the valve 10 through the inlet port 62, the orifice 12, the chamber 66 and the outlet port 65 of the switching valve assembly 60. Thus, the rightward movement of the diaphragm 45 of the actuator 14 and the retarding movement of the breaker plate are maintained until the negative pressure value in the vacuum chamber 28 of the valve 10 reaches the predetermined one so that the ignition timing of the engine is temporarily retarded in a predetermined period of time to reduce the NOx emission and, under this condition, the vehicle speed reaches a cruising speed by shifting operation of the transmission of the vehicle.

Thereafter, when the negative pressure value in the vacuum chamber 28 of the valve 10 reaches the predetermined one, the diaphragm 27 and the piston 30 of the valve 10 move downward against the biasing force of the coil spring 32 due to pressure difference between the vacuum and air chambers 28 and 29 to conduct switchover of the valve 10. At the same time, the diaphragm 68 and the plunger 69 of the switching valve assembly 60 are moved downward against the biasing forces of the springs 70 and 71 by pressure difference between the vacuum chamber 66 and the air chamber 67 to open the bypass valve 61. Thus, the vacuum chamber 28 of the valve 10 is directly communicated with the negative pressure port 17 across the bypass passage 72 of the switching valve assembly 60 so that the switchover operation of the valve 10 is promptly conducted, as shown in the $C_1$-area of FIG. 8. Then, the first inlet port 19 of the valve 10 is instantly connected to the second outlet port 23 to communicate the second servo-chamber 16 of the actuator 14 with the negative pressure of the throttle 11, whereas the second inlet port 21 is connected to the first outlet port 22 to communicate the first servo-chamber 15 of the actuator 14 with the atmospheric pressure by way of the air cleaner 20.

As a result, the diaphragm 45 of the actuator 14 is swiftly moved leftward by pressure difference between the two servo-chambers 15 and 16, and subsequently the breaker plate of the distributor 13 quickly advances the ignition timing of the engine, as shown in the $C_1$-area of FIG. 9. Thus, while the engine is running normally at a cruising speed, the normal ignition timing of the conventional device is maintained to ensure a best fuel burning efficiency or driveability of the engine, as shown in the C-area of FIG. 9.

Moreover, when the throttle valve 11 is temporarily closed to decelerate the vehicle or fully closed to arrest the vehicle, the inlet port 62 of the switching valve assembly 60 is communicated with the atmospheric pressure appearing upstream of the throttle valve 11 and, in turn, the check valve 74 is opened due to difference between the negative pressure in the chamber 66 and the atmospheric pressure applied to the inlet port 62. Thus, the vacuum chamber 28 of the valve 10 and the chamber 66 are instantly filled with the atmospheric pressure to promptly switchover the valve 10 to its original position and the distributor 13 is returned to its original position. Thereafter, if the throttle valve 11 is opened again to accelerate the vehicle, the negative pressure appearing downstream of the throttle valve 11 is applied to the first servo-chamber 15 of the actuator 14 through the negative pressure port 17, the first inlet and outlet ports 19 and 22 of the valve 10 conditioned in its original position so that the diaphragm 45 of the actuator 14 is moved rightward by pressure difference between the two servo-chambers 15 and 16 and the breaker plate of the distributor 13 is moved in the retarding direction from the initial position to temporarily retard the ignition timing of the engine.

Figure 10:
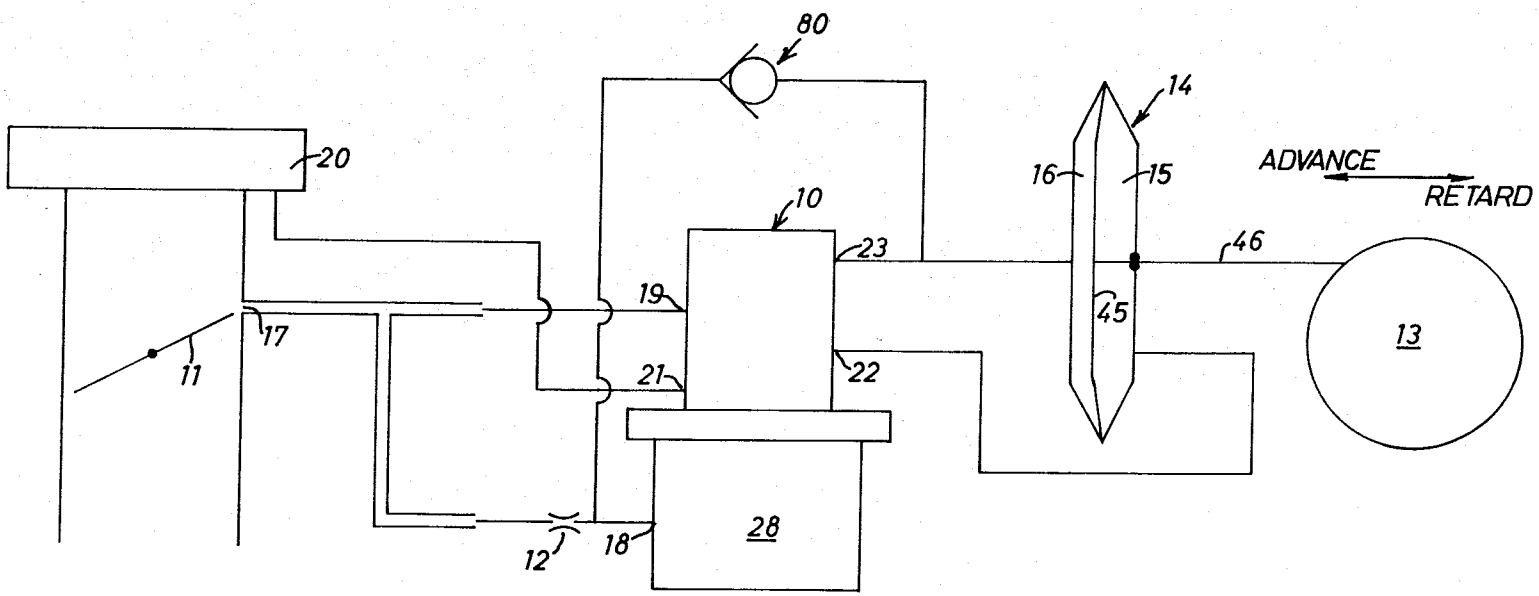
FIG. 10 illustrates a schematic diagram of a third preferred embodiment of the present invention.
Figure 11:
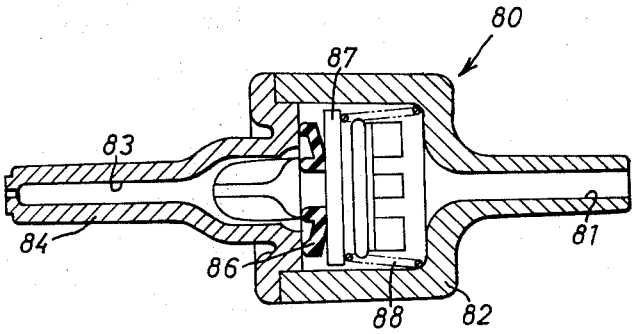
FIG. 11 shows a vertical cross-section of a check valve adapted to the third embodiment of FIG. 10.

FIG. 10 discloses a third embodiment of the present invention wherein a check valve 80 is interposed between the signal inlet port 18 and the second outlet port 23 of the change-over valve 10 of the ignition timing adjusting mechanism shown in FIG. 1 and the remaining parts and portions are designated by the same reference numerals as those of FIG. 1. In FIG. 11, there is illustrated an embodiment of the check valve 80 which comprises a first body 82 and a second body 84 hermetically coupled with the first body 82. The first body 82 is provided thereon with an inlet port 81 to be connected to the second outlet port 23 of the valve 10 and the second body 84 is provided thereon with an outlet port 83 to be connected to the signal inlet port 18 of the valve 10. In the interior of the two bodies 82 and 84, the outlet port 83 is normally closed by a valve element 86 integrally provided on a receiver 87 which is biased leftward by a compression coil spring 88.

In this third embodiment including the check valve 80, when the predetermined negative pressure is applied to the vacuum chamber 28 of the change-over valve 10 across the orifice 12 to start switchover operation of the valve 10, the check valve 80 is opened due to difference between negative pressure of the vacuum chamber 28 and negative pressure appearing at the outlet port 23 so that the vacuum chamber 28 is directly communicated with the negative pressure of the outlet port 23 across the check valve 80 to prompt the switchover operation of the valve 10.

Figure 13:
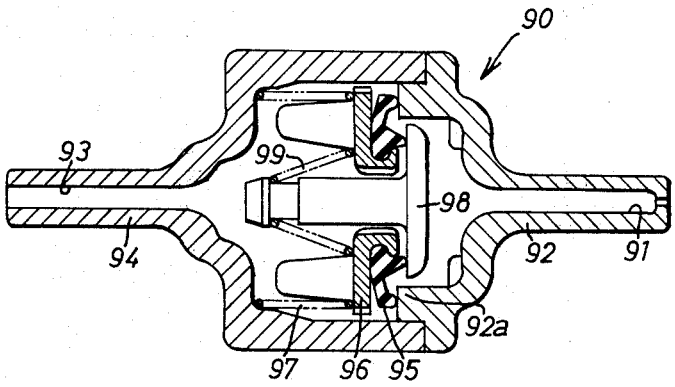
FIG. 13 shows a vertical cross-section of a dual check valve adapted to the fourth embodiment of FIG. 12.
Figure 12:
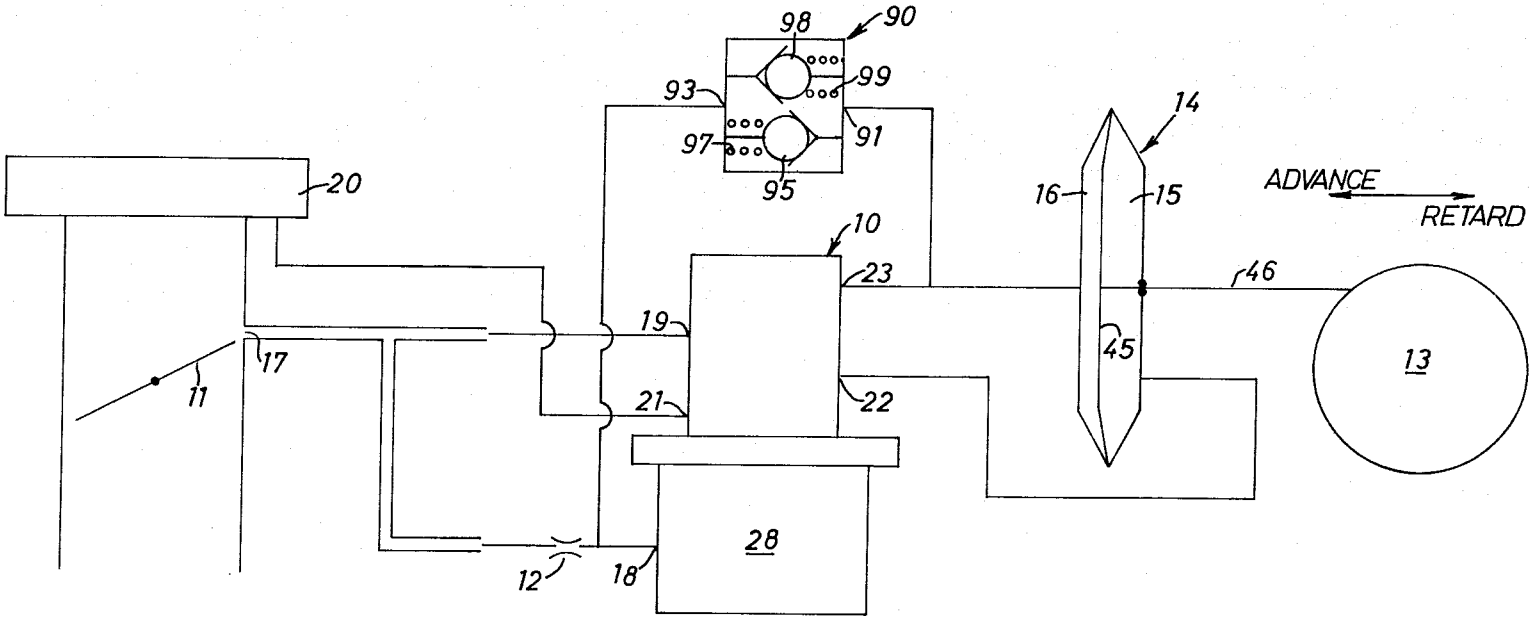
FIG. 12 illustrates a schematic diagram of a fourth preferred embodiment of the present invention.

FIG. 12 discloses a fourth embodiment of the present invention wherein a dual check valve 90 is interposed between the signal inlet port 18 and the second outlet port 23 of the change-over valve 10 provided within the ignition timing adjusting mechanism of FIG. 1 and the remaining parts and portions are designated by the same reference numerals as those of FIG. 1. In FIG. 13, there is illustrated an embodiment of the dual check valve 90 which comprises a first body 92 and a second body 94 hermetically coupled with the first body 92. The first body 92 is provided thereon with an inlet port 92 to be connected to the second outlet port 23 of the valve 10 and the second body 94 is provided thereon with an outlet port 93 to be connected to the signal inlet port 18 of the valve 10. In the interior of the two bodies 92 and 94, a first valve element 95 is integrally provided on a receiver 96 which is biased rightward by a ciol spring 97 to engage the valve element 95 on a shoulder 92*a* of the first body 92. A second valve element 98 assembled with the center of the receiver 96 is biased leftward by a compression coil spring 99 to be engaged with the first valve element 95.

In this fourth embodiment including the dual check valve 90, when the predetermined negative pressure is applied to the vacuum chamber 28 of the change-over valve 10 across the orifice 12 to start switchover operation of the valve 10, the second valve element 98 of the dual check valve 90 is opened due to difference between negative pressure of the vacuum chamber 28 and negative pressure appearing at the outlet port 23 so that the vacuum chamber 28 is directly communicated with the negative pressure of the outlet port 23 across the dual check valve 90 to prompt the switchover operation of the valve 10. Furthermore, in this fourth embodiment, when the throttle valve 11 is temporarily closed to decelerate the vehicle, the inlet port 91 of the dual check valve 90 is temporarily communicated with the atmospheric pressure appearing upstream of the throttle valve 11 by way of the second outlet port 23 and the first inlet port 19 of the valve 10 and the negative pressure port 17. Thus, the first valve element 95 of the dual check valve 90 is opened due to difference between the negative pressure in the vacuum chamber 28 and the atmospheric pressure applied to the inletport 91 so that the vacuum chamber 28 is instantly filled with the atmospheric pressure to instantly switchover the valve 10 in its original position.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. An ignition timing adjusting mechanism in combination with an internal combustion engine having a carburetor with a throttle valve and a distributor with a breaker plate for the engine, comprising:

a vacuum actuator provided therein including a diaphragm piston forming first and second servo-chambers in said actuator and operatively connected to said breaker plate of said distributor, said diaphragm piston being moved in one direction from an original position to move said breaker plate in a retarding direction and being moved in the other direction to move the breaker plate in an advancing direction;

a change-over valve means interposed between said vacuum actuator and said throttle valve of said carburetor for selectively connecting said first and second servo-chambers to atmospheric air and a negative pressure port upstream of said throttle valve therethrough, said valve means being changed-over from a first position, in which said first and second servo-chambers are respectively connected to the atmospheric air and said negative pressure port to move said diaphragm piston in one direction, to second position in which said first and second servo-chambers are respectively connected to said negative pressure port and the atmospheric air to move said diaphragm piston in the other direction; and means for delaying the switchover timing of said valve means to provide a predetermined time lag after occurrence of negative pressure at the throttle valve;

whereby when the throttle valve is closed and said valve means is conditioned in said first position, the breaker plate is positioned by said actuator in said original position, and when the throttle valve is opened with said valve means in said first position, the breaker plate is moved by said actuator in the retarding direction and subsequently moved in the advancing direction with the time lag upon switching-over of said valve means to said second position from said first position.

2. An ignition timing adjusting device as claimed in claim 1, wherein said change-over valve means comprises:

a housing provided thereon with a first inlet port connected to said negative pressure port, a second inlet port connected to the atmospheric pressure, a first outlet port connected to said first servo-chamber of said actuator, and a second outlet port connected to said second servo-chamber of said actuator;

a spring-loaded diaphragm piston assembled within said housing to form an air chamber in open communication with said second inlet port and a vacuum chamber connected to said negative pressure port;

a valve element assembled within said housing and associated with said diaphragm piston for connecting said first inlet port to said first outlet port and blocking the communication between said second inlet port and said second outlet port when said diaphragm piston is conditioned in its original position and for connecting said first and second inlet ports to said second and first outlet ports respectively when said diaphragm piston is moved by pressure difference between said air and vacuum chambers; and said means for delaying the switchover timing of said change-over valve means is a flow restriction means interposed between said negative pressure port and said vacuum chamber of said valve means.

3. An ignition timing adjusting device as claimed in claim 2, wherein a bypass valve means is connected in parallel with said flow restriction means to directly connect said vacuum chamber to said negative pressure port when a predetermined negative pressure is applied to said vacuum chamber across said flow restriction means to start switchover operation of said change-over valve means.

4. An ignition timing adjusting device as claimed in claim 2, wherein a check valve means is connected in parallel with said flow restriction means to directly connect said vacuum chamber to the atmospheric pressure appearing upstream of said negative pressure port when the throttle valve is closed.

5. An ignition timing adjusting device as claimed in claim 2, wherein a check valve means is interposed between said vacuum chamber and said second outlet port of said valve means to directly connect said vacuum chamber to negative pressure appearing at said second outlet port when a predetermined negative pressure is applied to said vacuum chamber across said flow restriction means to start switchover operation of said change-over valve means.

6. An ignition timing adjusting device as claimed in claim 2, wherein a check valve means is interposed between said vacuum chamber and said second outlet port of said change-over valve means to directly connect said vacuum chamber across said check valve means to the atmospheric pressure appearing upstream of said negative pressure port when the throttle valve is closed.

7. An ignition timing adjusting device as claimed in claim 2, wherein said flow restriction means is a sintered metal orifice.

8. An ignition timing adjusting device as claimed in claim 1, wherein said change-over valve means comprises:

a housing provided thereon with a first inlet port connected to said negative pressure port, a second inlet port connected to the atmospheric pressure, a first outlet port connected to said first servo-chamber of said actuator, and a second outlet port connected to said second servo-chamber of said actuator;

a spring-loaded diaphragm piston assembled within said housing to form an air chamber in open communication with said second inlet port and a vacuum chamber connected to said negative pressure port;

a first valve element assembled within said housing and associated with said diaphragm piston for connecting said first and second inlet ports to said first and second outlet ports respectively when said diaphragm piston is conditioned in its original position and for connecting said first and second inlet ports to said second and first outlet ports respectively when said diaphragm piston is moved by pressure difference between said air and vacuum chambers; and a second valve element incorporated with said first valve element for allowing the communication between said second inlet port and said second outlet port when said diaphragm piston is conditioned in its original position and for blocking the communication between said second inlet port and said second outlet port when said diaphragm piston is moved; and said means for delaying the switchover timing of said change-over valve means in an orifice means interposed between said negative pressure port and said vacuum chamber of said valve means.

* * * * *

UNITED STATES PATENT AND TRADEMARK OFFICE

CERTIFICATE OF CORRECTION

PATENT NO. : 4,050,423

DATED : September 27, 1977

INVENTOR(S) : Masami Inada et al

It is certified that error appears in the above-identified patent and that said Letters Patent are hereby corrected as shown below:

Under Section [73] Assignee, please delete "BoliviaTH OF JA" and insert therefor --Both of Japan--.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*